US005975223A

United States Patent [19]

Karlsson

[11] Patent Number: 5,975,223

[45] Date of Patent: Nov. 2, 1999

[54] ROCK DRILL BIT AND METHOD FOR HARDENING A ROCK DRILL BIT

[75] Inventor: Lennart Karlsson, Sandviken, Sweden

[73] Assignee: Sandvik AB, Sandviken, Sweden

[21] Appl. No.: 08/894,048

[22] PCT Filed: Mar. 11, 1996

[86] PCT No.: PCT/SE96/00312

§ 371 Date: Aug. 12, 1997

§ 102(e) Date: Aug. 12, 1997

[87] PCT Pub. No.: WO96/28632

PCT Pub. Date: Sep. 19, 1996

[30] Foreign Application Priority Data

Mar. 13, 1995 [SE] Sweden ..... 9500880

[51] Int. Cl.[6] ..... E21B 10/46

[52] U.S. Cl. ..... 175/374; 76/108.2

[58] Field of Search ..... 175/374, 371, 175/408; 384/95; 76/108.2

[56] References Cited

U.S. PATENT DOCUMENTS

| | | | |
|---|---|---|---|
| 3,275,389 | 9/1966 | Neilson et al. . | |
| 3,913,988 | 10/1975 | Scales et al. | 308/8.2 |
| 4,187,743 | 2/1980 | Thomas | 76/108.2 |
| 4,249,621 | 2/1981 | Espana | 175/227 |
| 4,627,882 | 12/1986 | Soderstrom | 148/14 |
| 4,660,444 | 4/1987 | Sorensen et al. | 76/108 |
| 4,867,015 | 9/1989 | Kane et al. . | |
| 5,289,889 | 3/1994 | Gearhart et al. | 175/325.5 |
| 5,415,243 | 5/1995 | Lyon et al. | 175/331 |

FOREIGN PATENT DOCUMENTS

| | | |
|---|---|---|
| 0 206 973 A2 | 12/1986 | European Pat. Off. . |
| 446 646 | 9/1986 | Sweden . |

*Primary Examiner*—David Bagnell
*Assistant Examiner*—Sunil Singh
*Attorney, Agent, or Firm*—Burns, Doane, Swecker & Mathis, L.L.P.

[57] ABSTRACT

The present invention relates to a rock drill bit for rotary crushing machining of rock. The rock drill bit includes legs (10), each of which carry a journal (11) provided with bearing surfaces (27, 28, 34) cooperating via bearing elements with bearing races in a rotatable roller provided with inserts or chisels. Each leg is made from a parent material with substantially homogeneous hardness and each leg comprises a leg tail (30) provided to resist entrance of drill cuttings into the bearings. The bearing surfaces (27, 28, 34) have higher wear resistance than the parent material and the leg tail (30) is at least partly of the same material condition as the bearing surfaces. The invention further relates to a method of manufacturing a rock drill bit.

7 Claims, 1 Drawing Sheet

FIG. 1
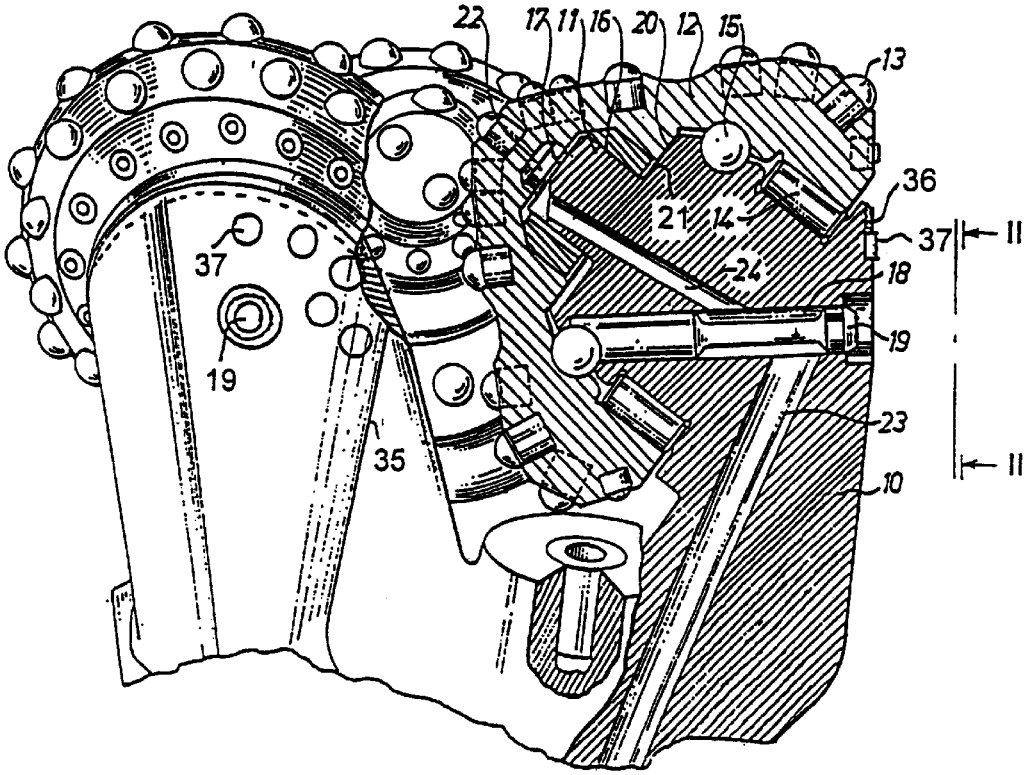
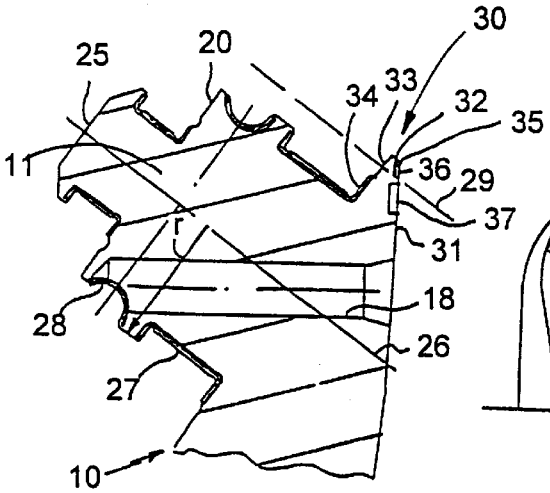
FIG. 3
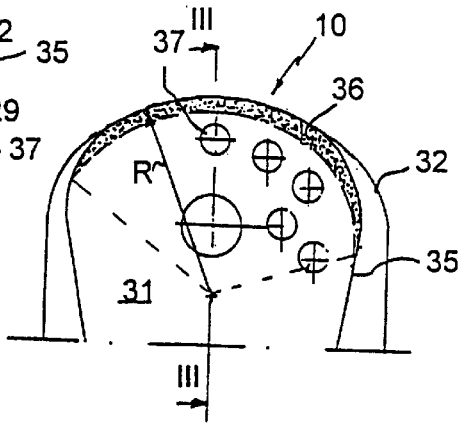
FIG. 2
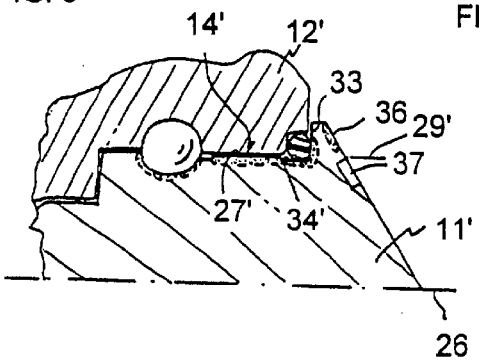
FIG. 4

ROCK DRILL BIT AND METHOD FOR HARDENING A ROCK DRILL BIT

BACKGROUND OF THE INVENTION

1. Field of the Invention

The present invention relates to a rock drill bit for rotary crushing machining of rock, which comprises at least one leg carrying a journal provided with bearing races in order to cooperate via a bearing element with bearing races in a rotatable roller provided with crushing means. The leg is made from a parent material with substantially homogenous hardness and comprises a leg tail provided to resist entrance of drill cuttings into the bearings. The invention further relates to a method for hardening a rock drill bit.

2. Description of Related Art

It is previously known to protect a roller drill bit leg end from wear by providing it with protective inserts and/or hard facing. The hard facing is necessary especially at the leg tail, where there is not enough space to mount the protective inserts. If the leg tail wears away, drill cuttings will quickly enter into the bearing races, which leads to bearing breakage or blocking of the bearings. The legs of a roller drill bit are carburized and hardened in order to achieve sufficient case depth and hardness of about 60 HRC on the bearing races. The core hardness on the other hand, lies about 30 HRC, in order to maintain suitable toughness and to decrease the risk for cracks and breakage. The low hardness of the legs however, wears the steel away too fast, unless protective inserts and hard facing are used.

OBJECTS OF THE INVENTION

In order to avoid the problems and the increased manufacturing costs that hard facing mean when producing roller drill bits, the present invention aims to provide a simple method of selectively hardening the legs during the heat treatment of the bit.

Another object of the present invention is to provide a roller drill bit with hardened portions, which have a good wear resistance.

BRIEF DESCRIPTION OF THE DRAWINGS

FIG. 1 shows a roller drill bit according to the present invention;

FIG. 2 shows a leg in a side view according to II—II in FIG. 1; and

FIG. 3 shows the leg in cross section according to the line III—III in FIG. 1.

FIG. 4 shows a part of a drill bit, in cross section, according to the present invention in an alternative embodiment.

DETAILED DESCRIPTION OF THE PREFERRED EMBODIMENTS

With reference to FIG. 1, a rock drill bit according to the present invention is shown, for rotary crushing, drilling of rock, referred to as a roller drill bit. The drill bit comprises three legs 10, whereof one is shown in section, on which journals 11 are provided. In some constructions of drill bits it is possible to provide only one or two legs. A roller 12 equipped with inserts 13, is rotatably mounted on each journal by means of roller bearings 14, a system of ball bearings 15, a radial bearing 16 and an axial bearing 17. The inserts can alternatively be replaced by other crushing means, such as chisel teeth integrated with the roller. The legs 10 are evenly distributed about the periphery of the bit with 120° partition. The journal 11 is provided with a channel 18 for introducing the balls 15, in which a plug 19 is received in order to retain the separate balls 15. The cylindrical roller bearing 14 receives a major part of the reactional force from the rock while the major object of the ball bearing 15 is to retain the roller 12 on the journal 11. The roller 12 has a shoulder 20 to abut against a collar 21 on the journal for receiving axial forces, which are not received by a support disc 22 cooperating with the axial endsurface 25 of the journal. The bit is provided with channels 23, 24 for a flush medium, such as pressurized air with an addition of water for cooling and cleaning of the bearing system. The above-mentioned bearings can be sealed and lubricated by a lubricant system integrated with the bit. A frictional bearing 14' can be provided in instead of roller bearing 14 on a substantially corresponding position according to FIG. 4.

It has been shown that the leg tails wear out during drilling and that drill cuttings, enter into the bearing races and destroy these by wear.

In FIG. 2 and primarily in FIG. 3, a journal 11 is shown, in which a frictional bearing 16 according to FIG. 1 has been replaced by a bearing race for a roller bearing. The journal 11 has a center line 26 about which roller 12 and the bearings 14, 15 rotate. The roller bearings 14 rotate along bearing races 27 and the balls 15 rotate in bearing races 28. The balls 15 preferably have a larger diameter than the roller bearings 14, whereof the radially outer point of the roller bearings 14 touches a line 29, parallel with the center line 26. The leg tail 30, according to FIG. 3, comprises a jacket surface 31, a tail surface 32 and a not hardened, passive internal surface 33, which is connected to an active axial stop surface 34 for the bearing 14. The tail surface 32 connects to the jacket surface 31 via an obtuse corner 35. The corner describes a bow of a circle or an ellipse at the leg tail, with a radius R which is larger than the largest radius r of the journal 11. The corner is always arranged radially outside the line 29. Protective inserts 37 may be provided in the jacket surface 31 in order to protect a weld which retains the plug 18.

The bearing races are darkened in FIG. 3, which designates an area hardened by case hardening. The method of hardening the darkened areas comprises the following principal steps: masking of surfaces which shall have enhanced wear resistance, painting or copper plating of the other surfaces which shall have the toughness of the parent material, demasking, carburizing, hardening and annealing. The hardened areas have higher hardness and wear resistance than adjacent, not carburized areas. In order to avoid carburizing, the areas on the legs that shall keep their original carbon are either painted or copper plated. Before said painting or copper plating commences, the corner 35 is covered by a mask, such as tape, along the bow 2–6 mm substantially axially rearwardly from the corner. When the bearing races and the leg tail have been masked, then painting commences such that the paint or the copper plating does not cover those surfaces. Thereby carbon cannot reach the painted surfaces.

Then, the drill bit legs 10 are inserted into an oven for carburizing the bearing races and possibly the sealing surfaces, for about 24 hours in carbon atmosphere. Then hardening takes place with subsequent cooling of the legs in preferably an oil bath, whereby the bearing races obtain a hardness of about 65 HRC, while in the core the hardness will be about 30 HRC. Then the bit is annealed in an oven at about 200–250° C. during about two hours, whereby the bearing race hardness decreases to about 60 HRC, such that the material there becomes less crack sensitive while the hardness of the core is maintained substantially unaltered, and whereby the leg tail has achieved an increased hardness on an area 36, which extends substantially 2–6 mm from the corner 35 and axially rearwardly. The area 36 extends from about 40° to about 160° in relation to the radius center of the bow, FIG. 2, where the area extends along a part of the leading edge of the rock drill bit, i.e., the edge which constitutes the wear side of the leg. The leeward side of the leg usually does not need any increase in wear resistance. The protective inserts 37 are provided in the parent material axially rearwardly of the area 36 with increased wear resistance and therefore, no machining is done in the hardened area when securing the protective inserts. The area 36 substantially extends between the tail surface 32 and the protective inserts 37, and preferably the line 29 is the axial rear border line of the area 36. The purpose of avoiding the hardening of the passive internal surface 33 is to maintain toughness in the leg tail core and inner side such that the leg tail cannot fracture during drilling. Also at the frictionally mounted, sealed bearing it is important to protect the leg tail, such as in FIG. 4. The bearing surfaces 27,28 and 34 have a particular higher wear resistance than the bearing drill bit parent material, steel, and the leg tail 30 has at least partly, substantially the same particular higher wear resistance as at least one of the bearing surfaces. With the latter term "substantially" is meant that also smaller differences in other elements included in the surfaces such as for example voluntarily increased nitrogen content in any of the surfaces.

After heat treatment, the legs are separately machined and welded together, during final assembly of the roller drill bit.

In FIG. 4 an alternative embodiment of a roller drill bit according to the present invention is shown wherein a frictional bearing 14' is provided instead of a roller bearing. The bearing surface 27' is provided close to a seal surface 34'. The passive surface 33 remains substantially unaltered. A seal means is provided between the roller 12' and the active axial stop surface or seal surface 34' of the journal, to stop cuttings from entering into the bearing system. The area 36 does not extend axially rearwards of the extension line 29' of the frictional bearing 14'. Furthermore the facts about the embodiment described in connection with FIGS. 1–3 are true also for the embodiment according to FIG. 4.

By providing a rock drill bit and a method according to the present invention the life of the bearings can be substantially extended compared to bits with unhardened leg tails and is simplified compared to the hard facing alternatives hitherto available, by hardening an area of the leg tail jacket surface simultaneously as hardening the bearing surfaces.

I claim:

1. A rock drill bit for rotary crushing machining of rock, comprising:

a leg carrying a journal provided with bearing surfaces cooperating via bearing elements with bearing races in a rotatable roller provided with crushing means, wherein the leg is made from a parent material with substantially homogenous hardness and including a leg tail provided to resist entrance of drill cuttings into the bearings, wherein the bearing surfaces have a particular higher wear resistance than said parent material, and wherein a part of the leg tail is at least partly of substantially the same particular higher wear resistance as at least one of the bearing surfaces.

2. The rock drill bit according to claim 1, wherein the leg tail comprises a jacket surface, a tail surface and a passive internal surface, the passive internal surface connected to an active axial stop surface of one of the bearing surfaces for a bearing or a seal, wherein part of the jacket surface is of substantially the same particular higher wear resistance as the bearing surfaces and protective inserts are provided in the parent material axially rearwards of the part of the leg tail which has the increased wear resistance, and the passive internal surface is of substantially the same homogenous hardness as the parent material.

3. The rock drill bit according to claim 1, wherein the leg tail comprises a jacket surface and a tail surface, the tail surface connects to the jacket surface via an obtuse corner, wherein the corner describes a bow at the leg tail, the bow defined by a radius which is larger than the largest radius of the journal and a radially outmost point of the bearings which touch a line extending parallel with a center line of the journal, said corner being constantly provided outside the line and wherein the leg tail has the increased wear resistance in an area which extends from the corner and axially rearwardly along the jacket surface.

4. The rock drill bit according to claim 1, wherein the part of the leg tail which is at least partly of substantially the same particular higher wear resistance as at least one of the bearing surfaces is an area that extends from about 40° to about 160° relative to the radius center of a bow formed at the leg tail defined by a radius which is larger than the largest radius of the journal and a radially outmost point of the bearings which touch a line extending parallel with a center line of the journal and therefore the area extends along a part of a leading edge of the rock drill bit, and wherein a passive internal surface, located between the area and an active axial stop surface of one of the bearing surfaces, has substantially the homogeneous hardness of the parent material.

5. The rock drill bit according to claim 1, wherein the part of the leg tail which is at least partly of substantially the same particular higher wear resistance as at least one of the bearing surfaces is an area which extends between a tail surface of the leg tail and axially rearward located protective inserts provided in the parent material, and wherein a line extending parallel with a center line of the journal constitutes an axially rearward border line of the area, and wherein the bearings comprise at least one of roller bearings, ball bearings and frictional bearings.

6. A method of hardening a rock drill bit for rotary crushing machining of rock, comprising a leg carrying a journal provided with bearing surfaces cooperating via bearing elements with bearing races in a rotatable roller provided with crushing means, wherein the leg is made from a parent material with substantially homogenous hardness and comprises a leg tail provided to resist entrance of drill cuttings into the bearings, wherein the bearing surfaces have higher wear resistance than said parent material, wherein the method comprises:

masking an area of a jacket surface of the leg tail that is to obtain an increased wear resistance before painting or copper plating the leg, so that the paint or the copper plating does not stick to those masked surfaces during painting or plating, and hardening the area of a jacket surface of the leg tail simultaneously with a hardening of the bearing surfaces.

7. The method according to claim 6, wherein the method step of hardening comprises the following principal steps; unmasking, carburizing and hardening and annealing.

* * * * *